US005647696A

United States Patent [19]

Sperber

[11] Patent Number: 5,647,696

[45] Date of Patent: Jul. 15, 1997

[54] LOOSE MATERIAL COMBINING AND DEPOSITING APPARATUS

[76] Inventor: Henry Sperber, 8 Red Fox La., Englewood, Colo. 80111

[21] Appl. No.: 516,656

[22] Filed: Aug. 18, 1995

[51] Int. Cl.[6] ..... B65G 53/48

[52] U.S. Cl. ..... 406/56; 406/41; 406/52; 406/67; 406/109; 406/120; 406/124; 406/135; 406/153; 406/154; 406/181; 198/575; 198/601

[58] Field of Search ..... 406/38, 39, 40, 406/41, 52, 53, 56, 63, 64, 65, 67, 108, 109, 120, 124, 135, 153, 181, 154; 198/575, 579, 601

[56] References Cited

U.S. PATENT DOCUMENTS

| | | | |
|---|---|---|---|
| 1,773,619 | 8/1930 | Goebels | 406/120 X |
| 2,120,003 | 6/1938 | Schanz | 406/135 X |
| 3,820,688 | 6/1974 | Weiste | 406/120 X |
| 4,111,493 | 9/1978 | Sperber | 406/64 |
| 4,113,148 | 9/1978 | Ernst | 406/120 X |
| 4,249,839 | 2/1981 | Vance | 406/120 X |
| 4,978,252 | 12/1990 | Sperber | 406/64 |

*Primary Examiner*—Andrew C. Pike
*Attorney, Agent, or Firm*—Sheridan Ross P.C.

[57] ABSTRACT

An apparatus for depositing loose materials, such as insulation or fireproofing in worksite areas, may be used for depositing a single or premixed loose material. Alternatively, the apparatus may be used both for combining two constituent loose materials to form a composite loose material and for depositing the composite loose material in a worksite area. The apparatus includes a separate hopper or bin for each of the constituent loose materials. Each hopper is operatively connected to a single loose material combining channel for supplying their respective constituent loose material for forming the composite loose material immediately before it is deposited in the worksite area. A single motor is used for supplying both constituent loose materials to the combining channel. The ratio of constituent loose materials in the composite loose material may be changed by replacing an easily accessible gear used in driving an auger for extracting the constituent loose material from one of the hoppers. In replacing this gear with a different sized gear, and thereby changing the ratio of constituent loose materials in the composite loose material, the hopper having the auger may be rotated to disengage the gear from a drive train, the gear is then replaced, and the hopper is rotated in the opposite direction until the replacement gear engages the drive train.

27 Claims, 10 Drawing Sheets

LOOSE MATERIAL COMBINING AND DEPOSITING APPARATUS

FIELD OF THE INVENTION

The present invention relates to an apparatus, used at a work site, for both combining different loose materials and depositing the resulting composite loose material, using pressurized air, in a desired work site area.

BACKGROUND OF THE INVENTION

In depositing a loose material, such as insulation, acoustical, and/or fireproofing material, into areas such as the insides of walls or in ceilings, the loose material is typically blown in with pressurized air using a loose material blowing apparatus which is transported to a work site where the loose material is to be deposited. An example of such an apparatus is disclosed in U.S. Pat. No. 4,978,252 of the same inventor as the present invention and wherein this patent is incorporated here by reference. Briefly, such an apparatus has a hopper for receiving the loose material and a chamber (hereinafter denoted an ejection chamber) into which the loose material from the hopper is conveyed so that, via an airstream through the ejection chamber, the loose material is blown through a flexible tubing attached to the apparatus and subsequently deposited in the desired work site area.

In some circumstances, however, it is desirable to have predetermined proportions of various loose materials thoroughly mixed and deposited together in a given work site area. For example, it may be desirable to have a mixture or composite loose material having three parts of insulation loose material and one part of fireproofing loose material deposited in a given area. In such a case, one common practice is to purchase a pre-mixed composite of the desired constituent loose materials. However, such pre-mixed compositions are typically more expensive than purchasing the constituent loose materials separately. Thus, it would be desirable to have a method and apparatus for depositing composite loose materials wherein the individual constituent loose materials can be provided to the apparatus at the work site separately and combined as needed.

SUMMARY OF THE INVENTION

The present invention is a method and apparatus for blowing a composite loose material into a desired area at a work site wherein the constituent loose materials of the composite loose material may be both combined and deposited into the desired area at the work site. In particular, the present invention is a method and apparatus for substantially automatically combining at least two different constituent loose materials in a predetermined proportion to yield a desired composite loose material wherein the loose material deposition functionality of the present invention is also utilized in the combining of the constituent loose materials. More particularly, the present invention includes at least two loose material hoppers for receiving two different loose material constituents of the composite loose material to be deposited or blown into a desired work site area. By configuring the apparatus of the present invention appropriately, the constituent loose materials in the hoppers are automatically combined and thoroughly mixed in any one of a plurality of predetermined desired proportions during the depositing of the composite loose material. This coordinated metering of the constituent loose materials is provided by allowing an operator to set the ratio of the extraction rates by which the extraction mechanism of each hopper extracts the constituent loose material from their respective hopper to form the composite loose material. More precisely, the operator may reconfigure a single loose material extraction mechanism associated with one of the hoppers thereby resulting each constituent loose material being fed in the desired proportion to an ejection chamber having an air stream flowing therethrough for depositing the composite loose material in the desired work site area.

Note that since the constituent loose material extraction mechanism for each of the hoppers extracts loose material substantially proportional to a rotational motion of a motor included in the apparatus of the present invention, it is an aspect of the present invention to allow a work site operator to quickly reconfigure the apparatus of the present invention so that different proportions of constituent loose materials may be provided in the composite loose material. In particular, such reconfiguring is accomplished by changing an externally accessible drive gear which thereby varies the ratio of the rotation rates between the extraction mechanisms for the different hoppers feeding constituent loose material to the ejection chamber.

It is a further aspect of the present invention that a single motor be used to drive both the combining of the constituent loose materials and the depositing of the composite loose material.

Additionally, it is an aspect of the present invention that, when desired, only a single hopper may be used if no loose material combining process is required.

Thus, the following additional benefits accrue to the present invention: (a) no measuring of the constituent loose materials by the operator is required for combining these materials, and (b) substantially all of the composite loose material is used, therefore leaving only a small amount of composite loose material remaining after a particular loose material depositing task is completed.

Other features and benefits of the present invention will become apparent from the detailed description with the accompanying figures contained hereinafter.

DETAILED DESCRIPTION

Figure 1:
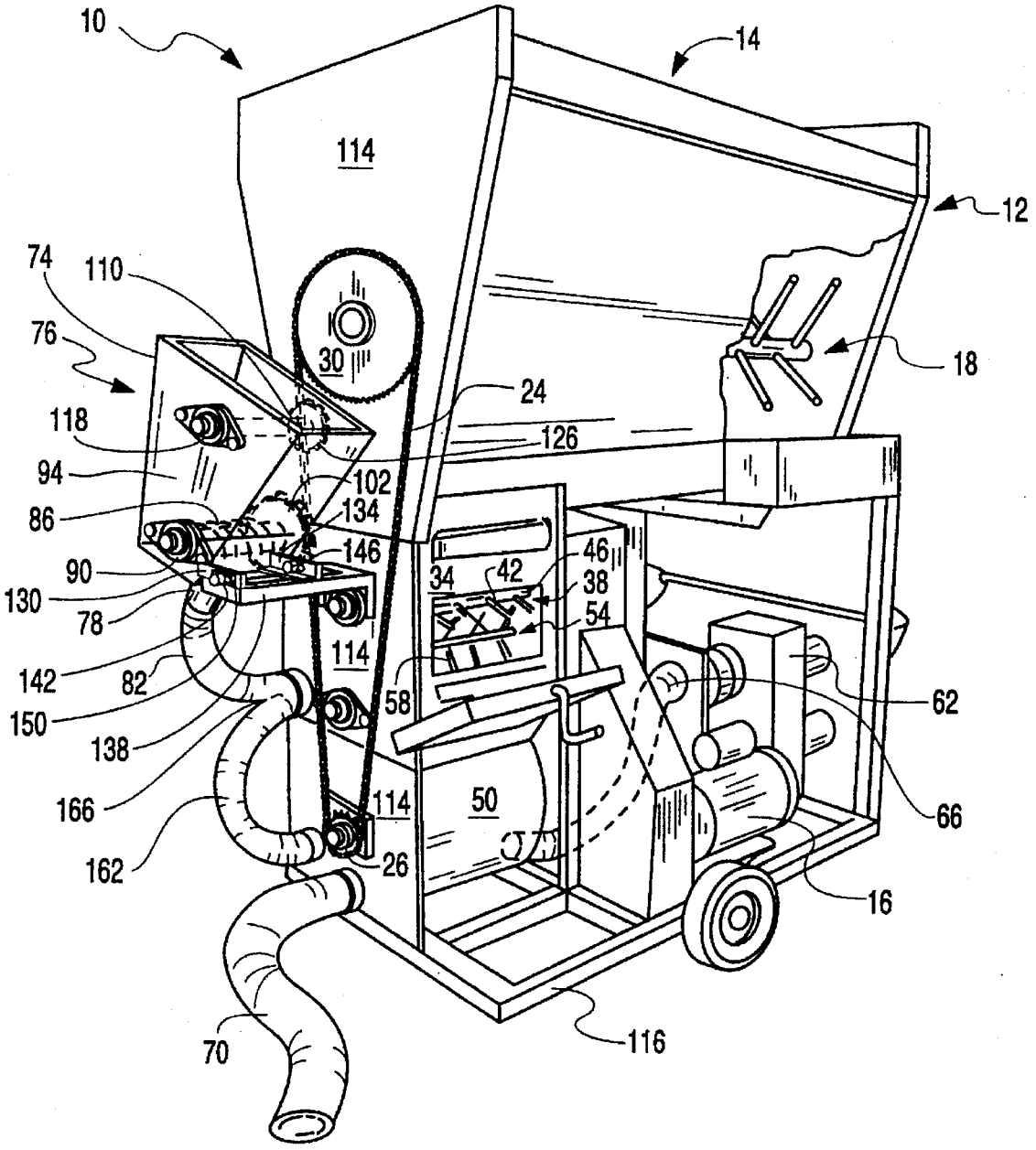
FIG. 1 is an perspective view of the present invention.
Figure 3:
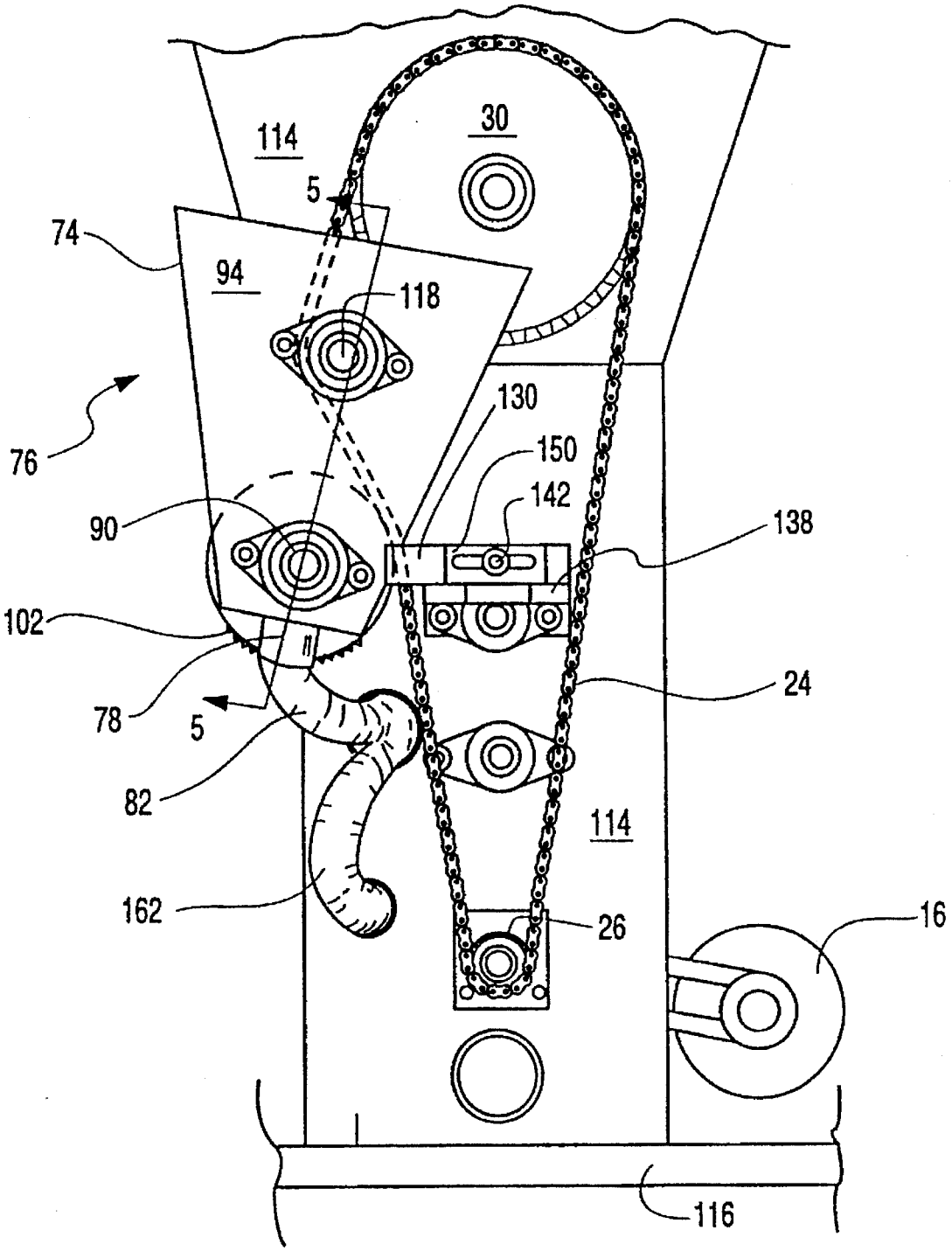
FIG. 3 is an end on view of the end of the preferred embodiment of FIG. 1 having the second hopper 74.

In FIG. 1, a drawing of the apparatus 10 of the present invention is shown. This apparatus includes a first hopper 12 for receiving a first type of loose material which is deposited into this hopper through the open top as indicated by arrow 14. Below the hopper 12 is a motor 16 which is used to rotate tine rotator 18 traversing the length of hopper 12 for circulating the loose material in the hopper 12. In particular, the tine rotator 18 is driven by motor 16 via a conventional linkage that includes drive chain 24 (best shown in FIG. 3) and drive gear 26, as well as gear 30 whose rotation directly rotates tine rotator 18.

The motor 16 also provides for the rotation of a number of other components of the present invention. For instance, the loose material of hopper 12 is extracted from the hopper through the bottom and enters vertical channel 34 by a loose material extraction mechanism in the vertical channel powered by motor 16. This extraction mechanism for hopper 12 includes tine rotator 38 having tines 42 wherein the motor 16 rotates the tine rotator shaft 46 via a conventional chain or belt linkage (not shown), thereby allowing the tines to urge the loose material downward through vertical channel 34 and into ejection chamber 50. Further, the motor 16 also rotates another tine rotator 54 having tines 58 wherein the rotation of tine rotator 54 also urges the loose material downwardly to enter the ejection chamber 50. Additionally, the motor 16 rotates a chamber partitioning paddle-wheel-like assembly (not shown) that is internal to the ejection chamber 50 as is disclosed in U.S. Pat. No. 4,978,252 having the same inventor as the present invention. It should be understood that, instead of a single motor, one or more separate electric motors could be utilized.

Also provided underneath the hopper 12 is an air blower 62 for providing a stream of air through tubing 66 to a lower portion of ejection chamber 50, wherein the air stream contacts the loose material deposited between two consecutive rotating paddle-wheel-like partitions of ejection chamber 50 for carrying the loose material into flexible tubing 70 for depositing in a work site area as directed by an operator.

Figure 4:
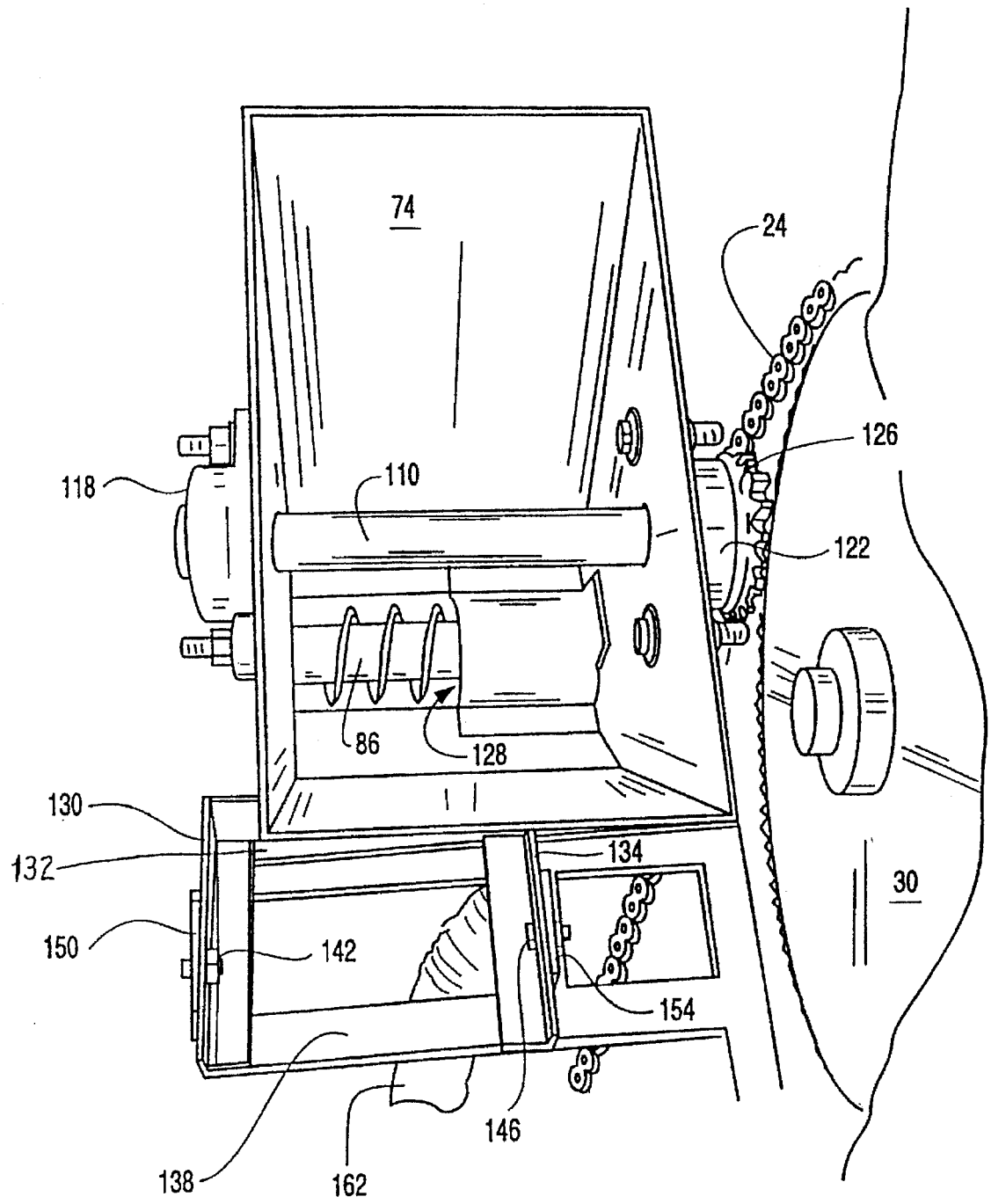
FIG. 4 is a top perspective view illustrating the interior of the second hopper 74.
Figure 5:
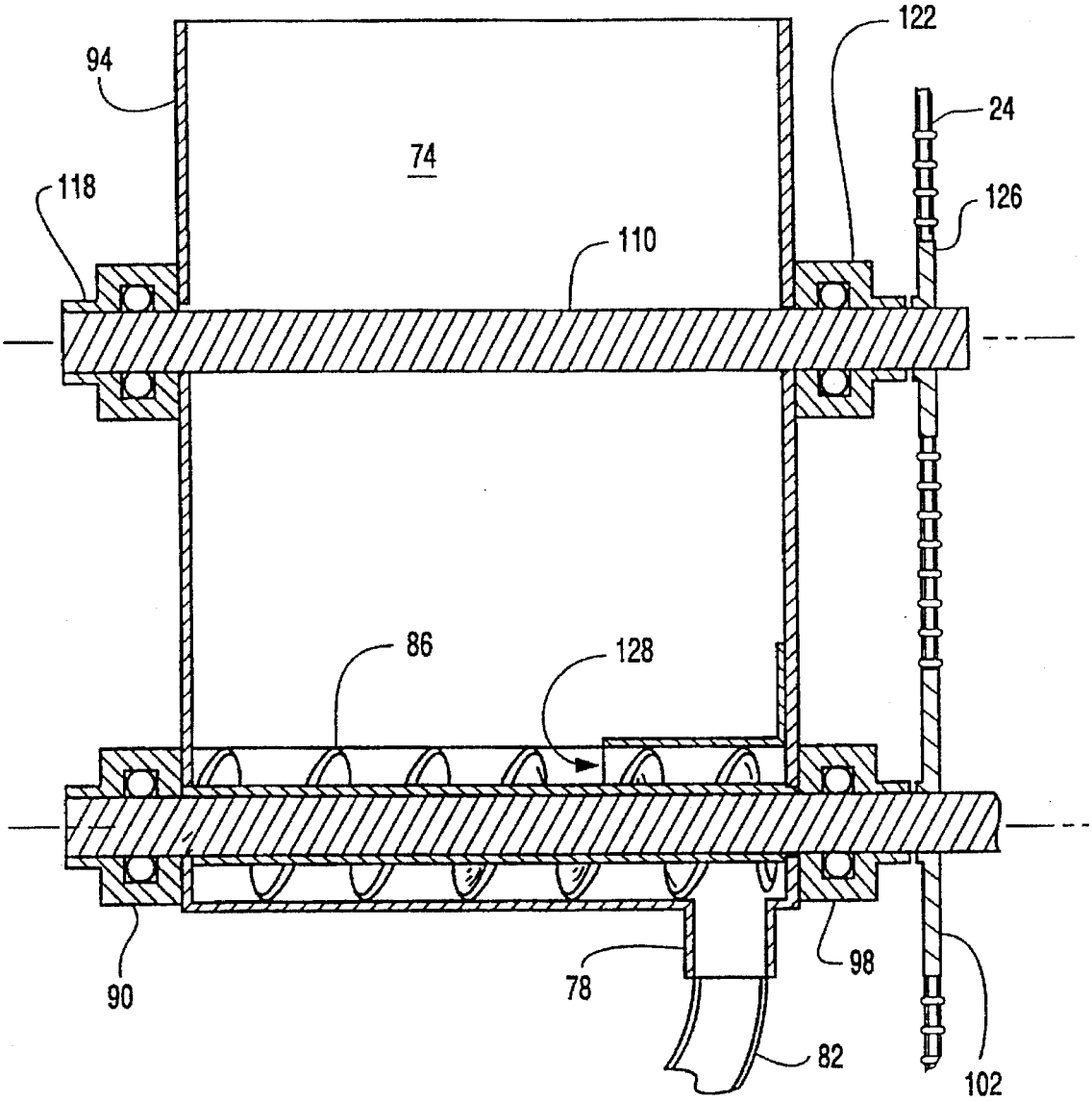
FIG. 5 is a cross-sectional view, taken along line 5—5 of FIG. 3, illustrating details of the shaft 110 and auger 86.

The present invention further includes a second hopper 74 for receiving a second loose material which can be combined with the first loose material from hopper 12. The longitudinal extent of the first hopper 12 is at least twice the longitudinal extent of the second hopper 74. The second hopper 74 is part of a hopper assembly 76 for providing the second loose material to the channel 34, wherein the hopper assembly further includes a loose material extraction mechanism for extracting the second loose material from hopper 74. In particular, this loose material extraction mechanism includes a rotatable auger 86 for urging the loose material in hopper 74 toward a bottom outlet 78 and through tubing 82, as best shown in FIG. 4. The hopper assembly 76 further includes bearing assemblies 90, 98 and a gear 102, wherein the auger 86 is rotatable on the bearing assemblies 90, 98 attached to the outside of hopper 74; i.e., bearing assembly 90 (FIG. 2) resides on the outside face 94 of the hopper 74 while the other end of the auger shaft 86 has both the opposing bearing assembly 98 (FIG. 5) and the gear 102 for rotating the auger in a manner that urges the second loose material within hopper 74 into the covered cavity 128 (FIG. 5) and subsequently out the bottom outlet 78 and into tubing 82. Additionally, hopper 74 also includes a shaft 110 which is substantially parallel to the auger 86 and which is the primary support for the hopper 74 for connecting this hopper to an end support 114, a portion of which may also be a side of hopper 12 (FIG. 1). Note that end support 114 transverses substantially the entire vertical length of the apparatus 10 and is fixedly attached to frame 116 that, in turn, provides support for substantially the entire apparatus 10. Thus, end support 114 provides support and positioning for gears 26 and 30 as well as for hopper 74. Further note that hopper 74 is rotatable about shaft 110. In particular, hopper 74 may be rotated about the shaft 110 through a relatively small angle as will be discussed further hereinafter. Still referring to shaft 110, note that this shaft also rotates on bearing assemblies at its terminating ends, one of which is provided on outside face 94 of hopper 74 and is labeled 118, while the other bearing assembly 122 (FIGS. 4, 5) is substantially identical. Moreover, between hopper 74 and side 114, a gear 126 is also provided on shaft 110. In a preferred embodiment, the gear 126 freewheels on the shaft 110, the gear 126 being used primarily to maintain tension on the drive chain 24.

Figure 2:
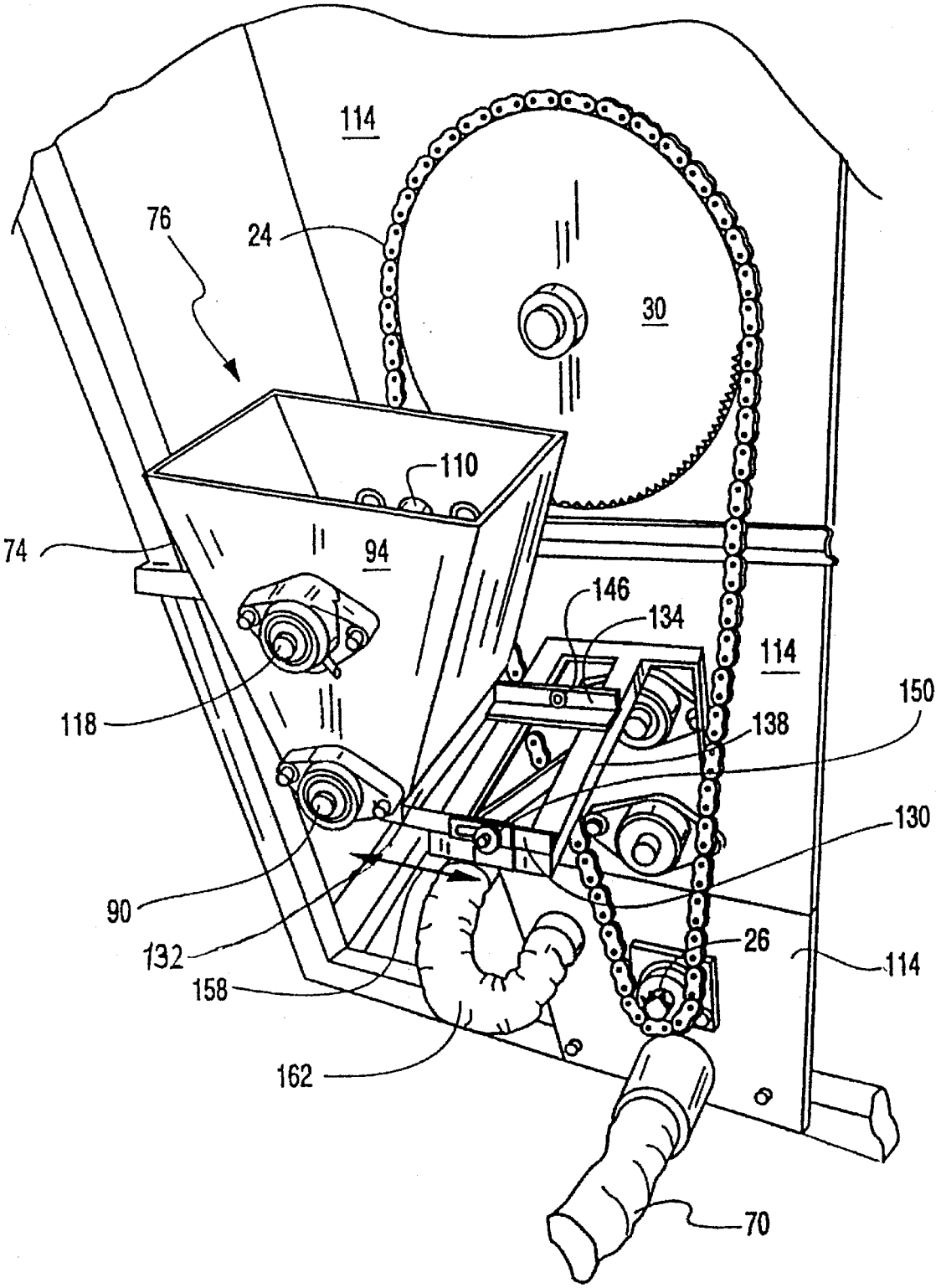
FIG. 2 is a perspective view of an end of the preferred embodiment of FIG. 1 where a second hopper 74 is attached.

Attached to the lower portion of hopper 74 and projecting substantially horizontally are two substantially parallel L-shaped projections 130, 134. Connector element 132 is disposed between the hopper 74 and the L-shaped projections 130, 134 and joins them together. In operation, each of these projections is bolted to a horizontal bracket or retainer 138 which, in turn, is fixedly attached to end support 114. Note that the retainer 138 is substantially perpendicular to the L-shaped projections 130, 134. Further note that the bolts 142, 146 that attach the L-shaped projections to vertical flanges 150, 154 of the horizontal retainer 138 may be used to fix the hopper 74 at various small angles from the vertical by rotating the hopper 74 about shaft 110 thereby shifting the L-shaped projections relative to the horizontal retainer 138 substantially in the directions of double-headed arrow 158 (FIG. 2).

Referring once again to tubing 82 (FIG. 1), note that in the preferred embodiment, this tubing joins with tubing 162, this latter tubing providing an air conduit for channeling a portion of the air stream flowing through and exiting ejection chamber 50 to facilitate the extraction of the second loose material from tubing 82. That is, the air stream in tubing 162 is used to lower the air pressure in tubing 82 and thereby cause the second loose material in tubing 82 to be sucked into the tubing junction 166 and subsequently into a lower portion of vertical channel 34 wherein the second loose material is thoroughly mixed with the first loose material from hopper 12 by rotating tines 58.

Figure 10:
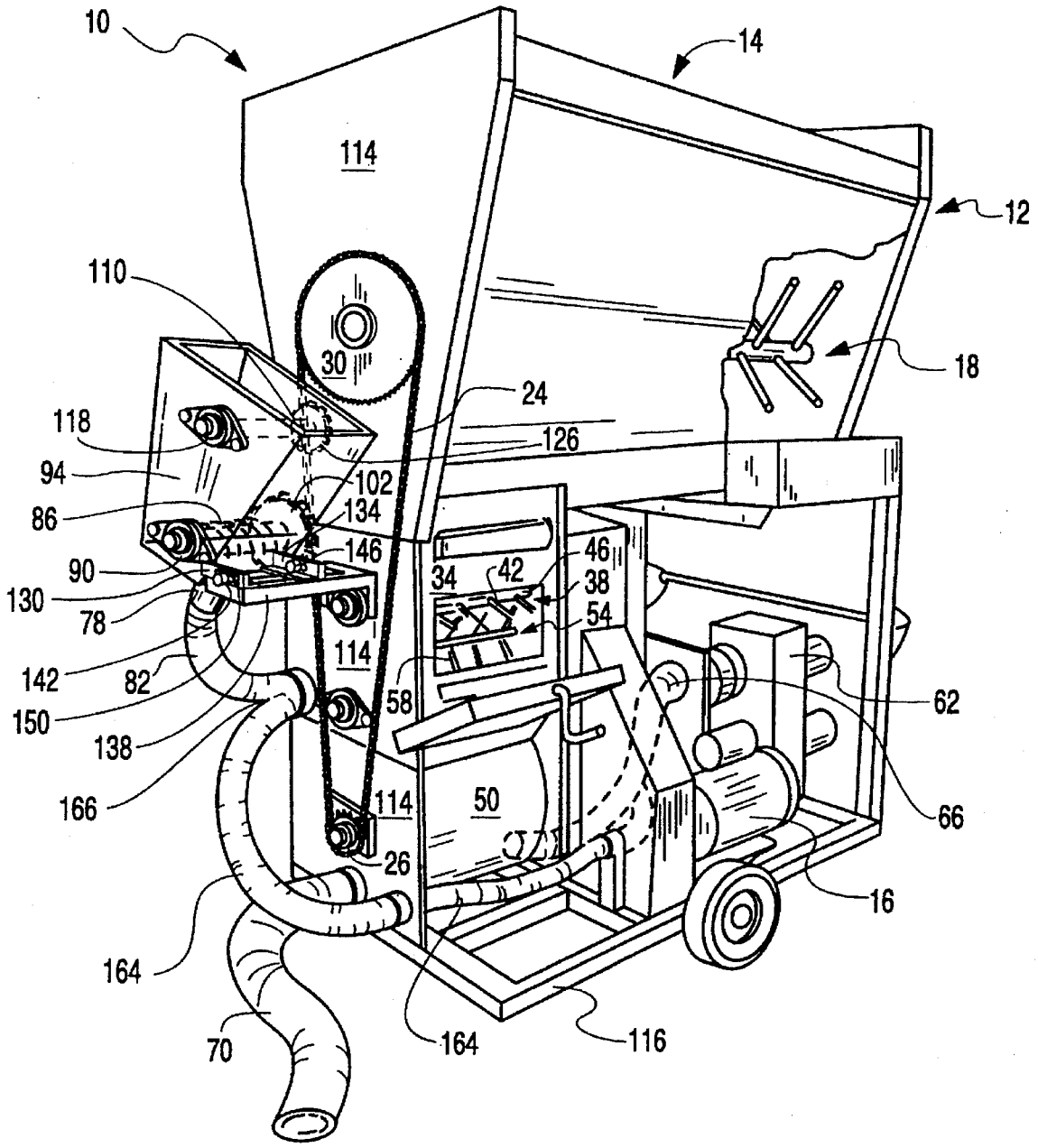
FIG. 10 is a perspective view of an alternative embodiment using tubing 164 instead of tubing 162.

FIG. 10 also shows an alternative tubing configuration for applying an air stream to facilitate the extraction of the second loose material from tubing 82. In particular, dash lined tubing 164 may be used instead of tubing 162. Note that tubing 164 taps into tubing 66 to obtain a portion of the airstream prior to the air stream entering ejection chamber 50 and thereby conveys a portion of the airstream to the tubing junction 166.

To operate the apparatus of the present invention, an operator transports the apparatus to the work site and determines whether a loose material currently on hand is acceptable for depositing or blowing into the desired work site areas. If so, then the operator enters the loose material into hopper 12 and activates both the motor 16 and the blower 62 and commences to deposit this loose material, via flexible tubing 70, into the work site area(s) to which the unattached end of tubing 70 is directed.

Alternatively, if the operator determines that a composite of a first loose material and a different second loose material is to be deposited in an area at the work site, then the operator determines the proportion or ratio of these two loose materials to be used and preferably decides to put the loose material having a larger volume in hopper 12 and the loose material having a comparatively smaller volume in hopper 74 (the second loose material preferably being a dry additive material to be added to the first loose material in comparatively small amounts). However, preferably prior to filling hopper 74, the operator consults documentation associated with the apparatus of the present invention to determine the size of gear 102 that will rotate the auger at a speed which will feed the appropriate relative amount of the second loose material into tubing 82. If any present gear 102 that is attached to the auger shaft 86 is inappropriate for the presently desired ratio of the first and second loose materials, then the operator loosens (if necessary) the bolts 142, 146 so that the hopper 74 may be rotated about shaft 110 through at least a small angle so that any currently attached gear 102 may be disengaged from the drive chain 24 and subsequently replaced by a different sized gear 102 that will rotate the auger 86 at a speed which is effective for supplying the appropriate amount of the second loose material to tube 82 and subsequently to vertical channel 34. Thus, once the appropriate gear 102 is placed on the auger shaft 86, the hopper 74 is then rotated in a counterclockwise direction until the new gear 102 meshes with the drive chain 24. Following this, the operator then tightens the bolts 142, 146, thereby fixing the hopper 74 into place so that the gear 102 remains in contact with the drive chain 24.

Following the above actions, the operator then preferably fills both hopper 12 and hopper 74 with the appropriate loose materials, and activates the motor 16 and the blower 62. Thus, the rotational output of the motor 16, through a conventional belt-drive linkage (not shown), drives the gear 26 which in turn drives the drive chain 24 about gear 30 for rotating the tine rotator 18 in hopper 12 and also for rotating gear 102 attached to auger 86. Further note, motor 16 also drives tine rotators 38, 54 at a rotational rate that is in a fixed relationship to the rotational rate of the motor 16. Thus, the first material in hopper 12 is substantially extracted by tine rotator 38 at a rate that varies only with the rotational variation of motor 16 while, on the other hand, the rotational rate of the auger 86 for extracting the second loose material from hopper 74 varies according to both the rotational rate of motor 16 and the size of the gear 102 provided on auger shaft 86. Thus note, as an aside, that it has been determined that, for typical operating ranges for motor 16, the loose material extraction mechanisms from the hoppers 12, 74 as disclosed hereinabove provide extraction rates that are in a substantially constant ratio for a given gear 102. Further note that the second loose material enters the vertical chamber 34 in a proximity of tine rotator 54 thereby allowing for a thorough mixing of the first and second loose materials, thus insuring that a composite loose material of uniform consistency is supplied to the desired work site area having a substantially constant ratio of the first and second loose materials.

Figure 6:
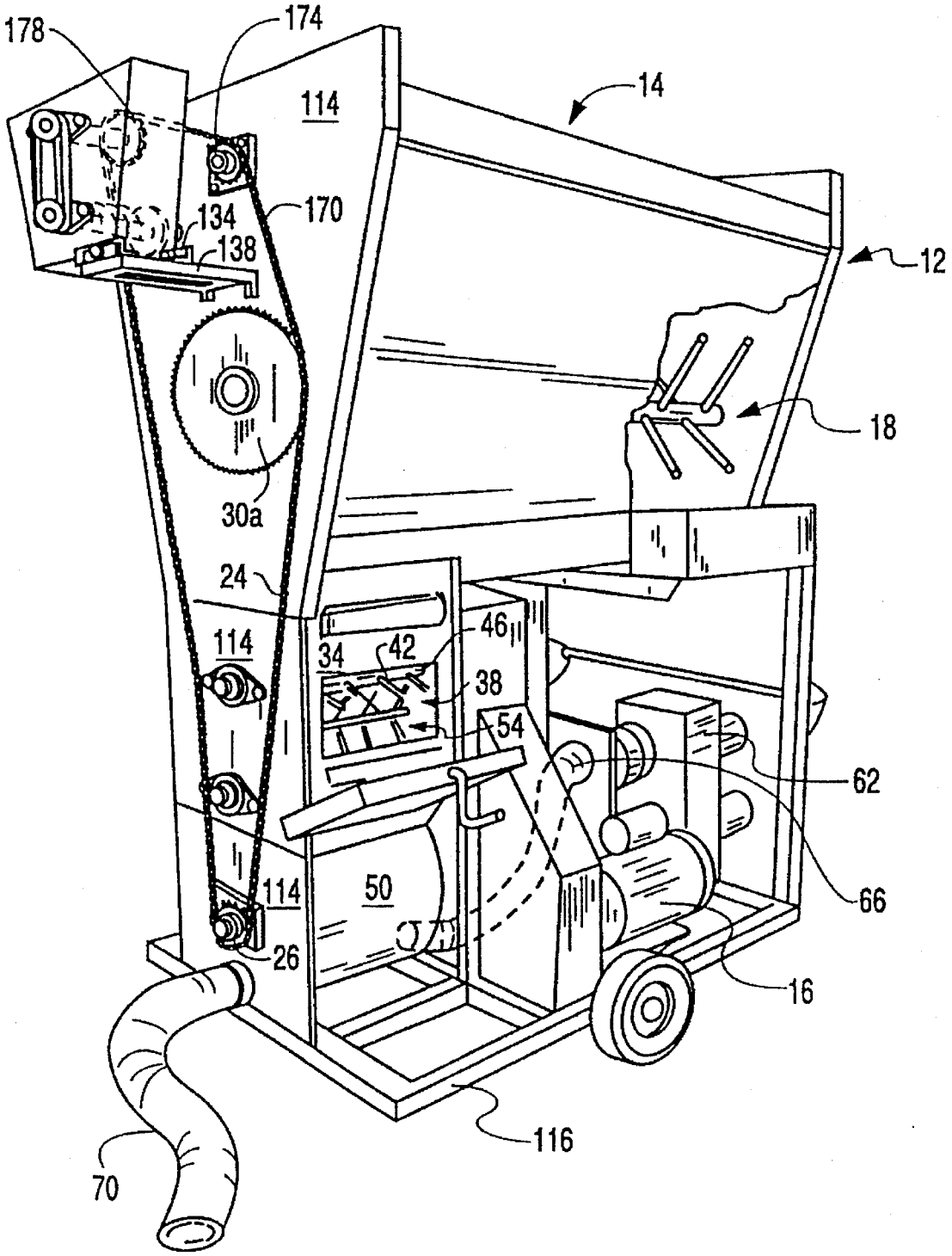
FIG. 6 is an alternative embodiment of the present invention showing the second hopper 74 supplying its loose material directly to the first hopper (hopper 12)
Figure 7:
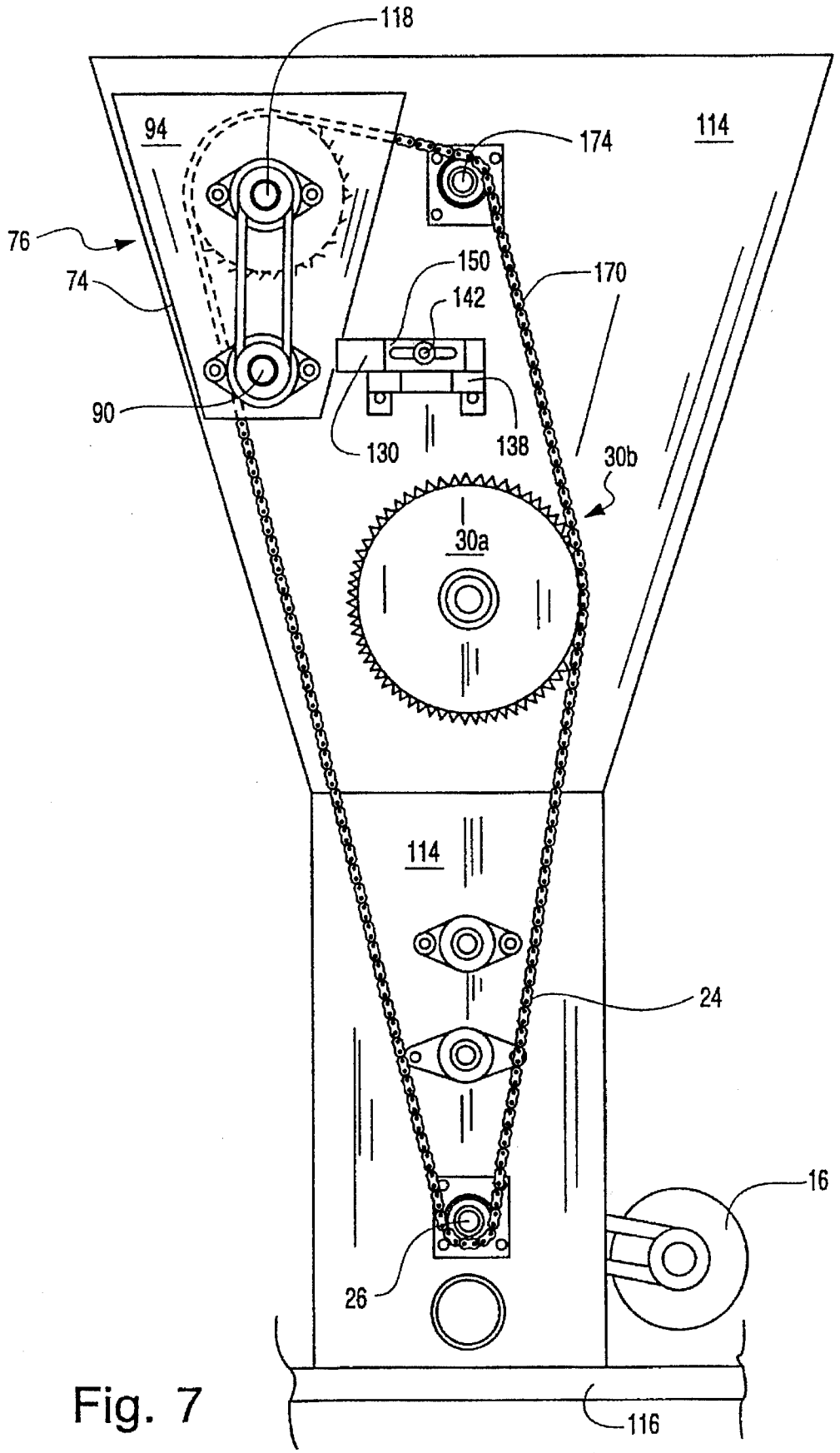
FIG. 7 is a side view of the end of the alternative embodiment of the present invention.

Alternative embodiments of the present invention are provided in FIGS. 6–9. FIGS. 6 and 7 show an alternative embodiment, wherein the hopper 74 is attached to hopper side 114 above gear 30 so that instead of the second loose material feeding into vertical chamber 34, the second loose material is instead provided directly into hopper 12. Note that in this embodiment, the second loose material is not urged through tubing 82 by an air stream as in FIG. 1. Therefore, neither tubing 162 nor 164 is necessary. It is usually preferred that air not be used where the loose material has a low density, which is found in materials such as wood ash, powder products, and other suitable products that would have a density similar to talcum and Portland cements. In order to drive gear 102 in a manner similar to the first embodiment of the present invention, the drive chain and gear configuration of FIG. 3 requires modification. One such modified configuration is provided in FIG. 7, wherein gear 30 now becomes two parallel equal sized gears that rotate in unison, the outermost of these two gears being labeled 30*a* in FIG. 7 and the second gear being directly behind gear 30*a* being labeled 30*b*. Two gears 174,178 provide a configuration for drive chain 170 wherein the gear 102 can be effectively driven by the drive chain 170 and yet also capable of being replaced by a different gear 102 in the same fashion as in the first embodiment of the invention.

Figure 8:
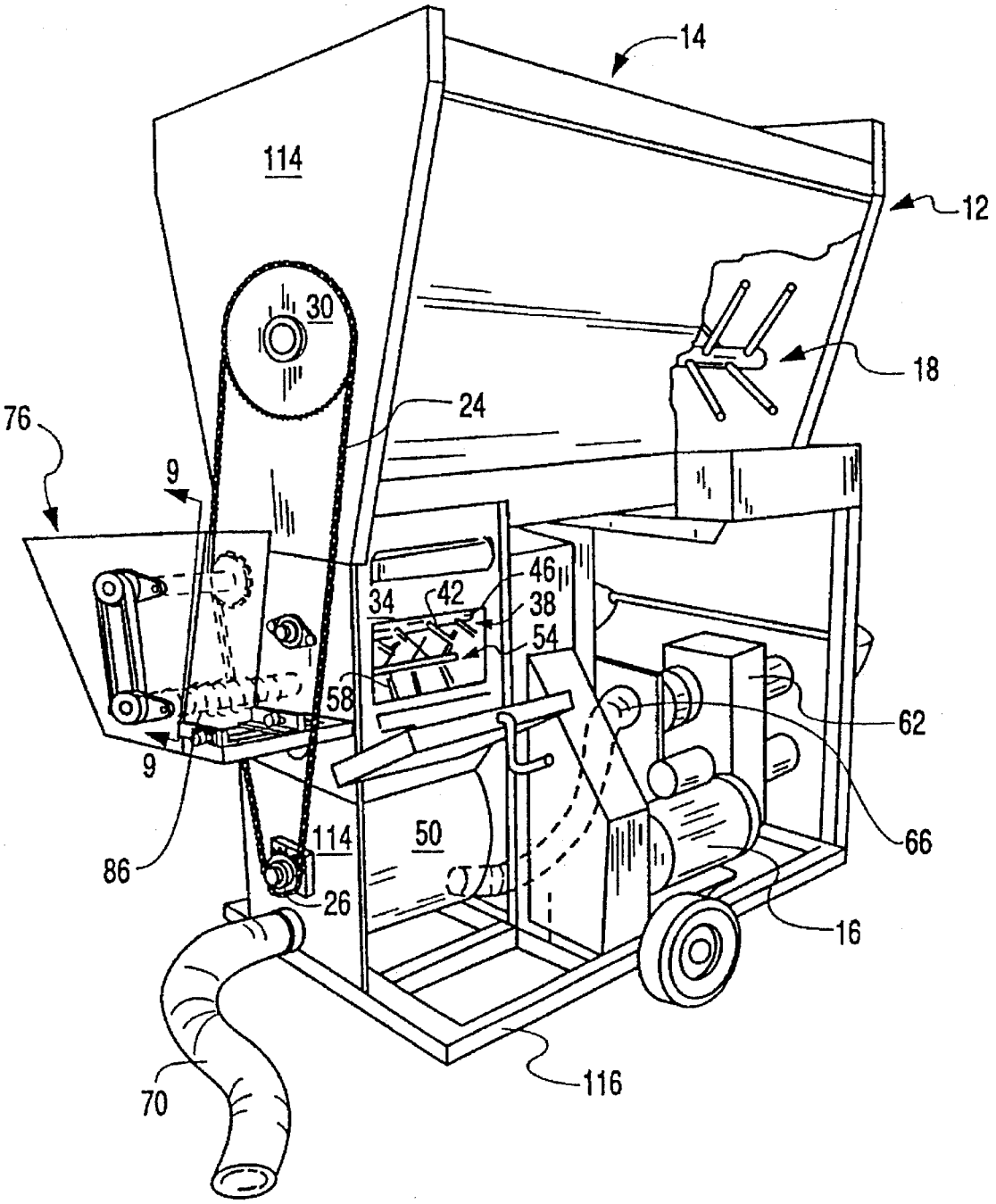
FIG. 8 is another alternative embodiment of the present invention illustrating direct communication from the second hopper 74 to the vertical channel 34.
Figure 9:
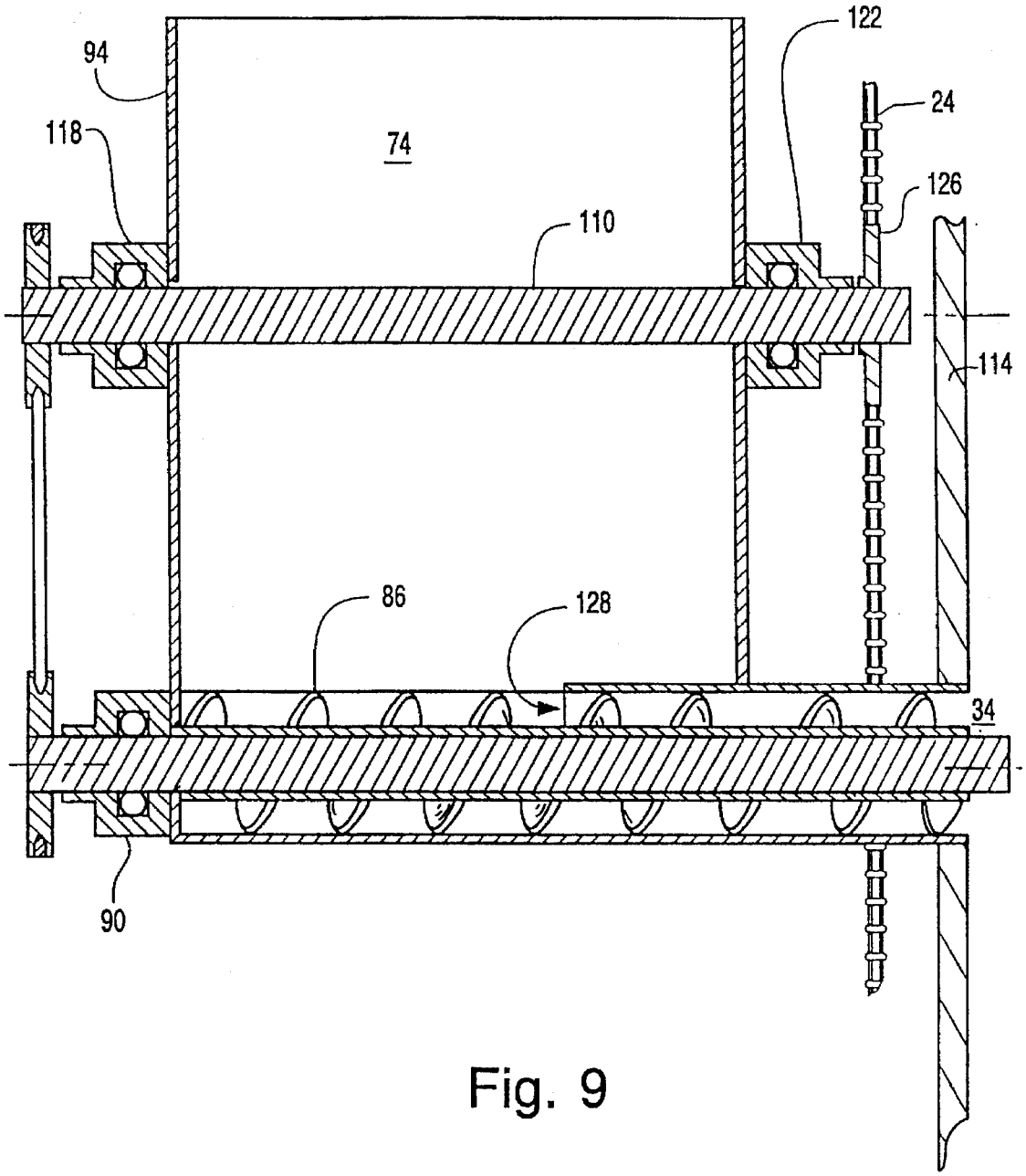
FIG. 9 is an enlarged, fragmentary cross-section, taken along line 9—9 of FIG. 8.

In the further embodiment of FIGS. 8 and 9, the hopper 74 is attached adjacent to the tine rotator 38 so that the auger shaft 86 communicates directly therewith. That is, the second loose material is fed directly into the vertical channel 34 from the hopper 74 using the auger shaft 86. Additionally, as in FIGS. 6 and 7, the second loose material is not urged through tubing 82 by an air stream. Thus, again, neither tubing 162 nor 164 are necessary.

The foregoing discussion of the invention has been presented for purposes of illustration and description. Further, the description is not intended to limit the invention to the form disclosed herein. Consequently, variation and modification commensurate with the above teachings, within the skill and knowledge of the relevant art, are within the scope of the present invention. The embodiment described hereinabove is further intended to explain the best mode presently known of practicing the invention and to enable others skilled in the art to utilize the invention as such, or in other embodiments, and with the various modifications required by their particular application or uses of the invention. It is intended that the appended claims be construed to include alternative embodiments to the extent permitted by the prior art.

What is claimed is:

1. A method for providing a composite loose material at a work site, said method comprising:

providing a first loose material for receipt in a first hopper located at the work site;

providing a separate second loose material for receipt in a second hopper located at the work site, said second hopper included in a hopper assembly in communication with said first hopper and in which said hopper assembly further includes a loose material extraction means for extracting said second loose material from said second hopper;

determining a desired ratio of said first loose material to said second loose material;

configuring said loose material extraction means so that said second loose material is extracted from said second hopper at a rate to provide said desired ratio of said first and second loose materials and in which said step of configuring includes incorporating an appropriate sized gear into said loose material extraction means so that said second loose material is extracted at said rate and with said step of incorporating including rotating said second hopper for disengaging said loose material extraction means from a drive train used for extracting said first and second loose materials from said first and second hoppers, respectively;

inputting said first loose material to said first hopper at the work site;

inputting said second loose material to said second hopper at the work site;

combining, after said determining and configuring steps, said first and second loose materials from said first and second hoppers, respectively, to obtain the composite loose material;

wherein said step of combining includes a step of extracting, at said desired ratio, said first and second loose materials from said first and second hoppers, respectively;

supplying to a hose assembly the composite loose material; and outputting the composite loose material from said hose assembly to a desired area at the work site.

2. A method, as claimed in claim 1, wherein said step of extracting includes rotating an auger included in said loose material extraction means for urging said second loose material to exit said second hopper.

3. A method, as claimed in claim 1, wherein said step of combining includes delivering said first and second loose materials to a common channel having rotating tines for mixing said first and second loose materials.

4. A method, as claimed in claim 3, wherein said step of delivering includes conveying said second loose material to said common channel using a stream of air.

5. A method, as claimed in claim 1, wherein said step of extracting includes controlling an extraction rate of said first loose material from said first hopper using substantially a rotation rate of a motor.

6. A method, as claimed in claim 5, wherein said step of extracting further includes controlling said second loose material from said second hopper using said rotation rate of said motor.

7. An apparatus for providing a composite loose material at a work site, said apparatus comprising:

first hopper means located at the work site for containing a first loose material;

first conveying means joined to said first hopper means for conveying the first loose material from said first hopper means;

second hopper means for containing a second loose material;

second conveying means operatively joined to said second hopper means for conveying the second loose material, said first and second conveying means being driven by a single motor joined to said first and second hopper means by means for connecting;

deposition means operatively joined to said first and second conveying means for depositing the composite loose material in a desired work site area, the composite loose material having the first and second loose materials as constituents; and ratio setting means for setting a desired ratio of the first and second loose materials used in obtaining the composite loose material, said ratio setting means being joined to said second hopper means, said ratio setting means including a shaft connected to said means for connecting and in which said second hopper means is rotatable about said shaft.

8. An apparatus, as claimed in claim 7, wherein said second hopper means is connected to said first hopper means using at least one of: (a) a support means for supporting said second hopper means; and (b) frame means for supporting substantially all of said apparatus.

9. An apparatus, as claimed in claim 7, wherein said first hopper means includes a tine means for circulating the first loose material in said first hopper means.

10. An apparatus, as claimed in claim 7, wherein said deposition means includes combining means for receiving the first and second loose materials from said first and second conveying means, respectively, and mixing the first and second loose materials to obtain the composite loose material.

11. An apparatus, as claimed in claim 10, wherein said first conveying means includes rotating tine means for conveying the first loose material from said first hopper means to said combining means.

12. An apparatus, as claimed in claim 10, wherein said second conveying means includes an auger within said second hopper means for moving the second loose material through an opening in said second hopper means.

13. An apparatus, as claimed in claim 12, wherein said second conveying means further includes a tubing means for receiving the second loose material from said opening when said auger is rotatably moving the second loose material through said opening.

14. An apparatus, as claimed in claim 13, wherein said second conveying means further includes an air stream conduit, connected to said tubing means, for urging the second loose material through said tubing means and into said combining means.

15. An apparatus, as claimed in claim 14, wherein said combining means includes a channel for receiving the first and second loose materials.

16. An apparatus, as claimed in claim 10, wherein said combining means includes rotating tine means for mixing the first and second loose materials, thereby obtaining the composite loose material.

17. An apparatus, as claimed in claim 7, wherein said deposition means includes means for supplying an air stream to the composite loose material, thereby urging the composite loose material to the desired work site area.

18. An apparatus, as claimed in claim 17, wherein said means for supplying the air stream includes an air blower and an attached air stream conduit, said air blower being joined to said first hopper means by said means for connecting.

19. An apparatus, as claimed in claim 17, wherein said deposition means further includes a hose assembly in communication with said means for supplying the air stream for carrying the composite loose material to the desired work site area.

20. An apparatus, as claimed in claim 7, wherein said ratio setting means includes a gear operatively attached to said second conveying means for transferring movement from said motor to said second conveying means, wherein said gear is replaceable at the work site to change a rate by which the second conveying means conveys the second loose material out of said second hopper means.

21. An apparatus, as claimed in claim 20, wherein said second conveying means comprises an auger, and said gear drives said auger in said second conveying means.

22. An apparatus, as claimed in claim 20, wherein said ratio setting means further includes retaining means for retaining said second hopper means in a desired orientation of a plurality of orientations during activation of said second conveying means so that said gear is driven by said motor, said retaining means being fixedly attached to said means for connecting.

23. An apparatus, as claimed in claim 22, wherein said ratio setting means further includes projection means extending from said second hopper means for being received in said retaining means when said second hopper means is rotated through said plurality of orientations about said shaft.

24. An apparatus for providing a composite loose material at a work site, said apparatus comprising:

a first hopper located at the work site for containing at least a first loose material, said first hopper having a wall and a longitudinal extent;

a first conveyor joined to said first hopper and conveying at least the first loose material from said first hopper;

a second hopper located at the work site for containing a second loose material, said second hopper having a wall and a longitudinal extent, said longitudinal extent of said first hopper being at least twice said longitudinal extent of said second hopper;

a second conveyor joined to said second hopper for conveying the second loose material from said second hopper;

a shaft spaced above said second conveyor and extending through said wall of said second hopper;

a gear connected to one of said shaft and said second conveyor;

means for operably connecting together each of said gear, said shaft, and said second conveyor;

mixing means disposed in a path of the first loose material and the second loose material for mixing the first and second loose materials together; and a motor operably connected to each of said gear, said second conveyor, and said mixing means for causing each of them to move.

25. An apparatus, as claimed in claim 24, wherein said gear is connected to said second conveyor.

26. An apparatus, as claimed in claim 24, wherein said mixing means includes at least portions of said first conveyor.

27. An apparatus, as claimed in claim 24, wherein said motor drives each of said first conveyor, said second conveyor, and said mixing means.

* * * * *